US005897074A

United States Patent [19]

Marino

[11] Patent Number: 5,897,074

[45] **Date of Patent: *Apr. 27, 1999**

[54] MOIST TISSUE DISPENSER HAVING SEALING ARMS

[75] Inventor: John J. Marino, Winchester, Mass.

[73] Assignee: NuWay Corporation, Winchester, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/688,310

[22] Filed: Jul. 30, 1996

[51] Int. Cl.[6] ..... B65H 16/02; B65H 16/06

[52] U.S. Cl. ..... 242/594.1; 242/596.8; 242/598.6; 242/594.5

[58] Field of Search ..... 242/594.1, 594.5, 242/598.3, 599.1, 595, 595.1, 596.8, 597.8, 598.6, 560, 560.2, 598.5; 206/409; 225/51

[56] References Cited

U.S. PATENT DOCUMENTS

| | | | |
|---|---|---|---|
| 2,685,365 | 8/1954 | Sieven | 242/560 X |
| 2,790,608 | 4/1957 | Sieven | 242/596.8 X |
| 2,798,597 | 7/1957 | Thompson | 242/595 X |
| 3,288,329 | 11/1966 | Ketchem | 206/409 X |
| 3,335,973 | 8/1967 | Genn | 242/598.6 X |
| 3,532,210 | 10/1970 | Minion et al. | 242/596.8 X |
| 3,830,198 | 8/1974 | Boone | 242/594.5 X |
| 3,837,595 | 9/1974 | Boone | 242/594.5 |
| 3,948,454 | 4/1976 | Bastian | 242/597.8 X |
| 4,427,159 | 1/1984 | Miller et al. | 242/598.6 X |
| 4,730,778 | 3/1988 | Akao et al. | 206/409 X |
| 4,796,832 | 1/1989 | Schutz et al. | 242/594.5 |
| 4,834,316 | 5/1989 | DeLorean | 242/596.8 X |
| 5,012,986 | 5/1991 | Needle | 242/597.8 X |
| 5,207,367 | 5/1993 | Dunn et al. | 206/409 X |
| 5,439,521 | 8/1995 | Rao | 242/599.1 X |
| 5,482,223 | 1/1996 | Bresina et al. | 242/598.3 X |
| 5,598,987 | 2/1997 | Wachowicz | 242/597.8 |

*Primary Examiner*—Daniel P. Stodola
*Assistant Examiner*—Gregory J. Strimbu
*Attorney, Agent, or Firm*—Paul J. Cook

[57] ABSTRACT

A dispenser for moist tissue including a housing for a moist tissue roll and a slot in the housing for dispensing the tissue from the roll. The dispenser includes arms for hanging the dispenser far from a fixed element. The arms also effect a seal between housing sections forming the housing.

30 Claims, 13 Drawing Sheets

MOIST TISSUE DISPENSER HAVING SEALING ARMS

BACKGROUND OF THE INVENTION

This invention relates to a dispenser for moist tissues. More particular, the present invention relates to a dispenser for moist tissues which effectively seals moist tissue housed within the dispenser to maintain it moist and which includes means for hanging the dispenser from a conventional toilet tissue holder.

Premoistened tissues are formed from a highly absorbant sheet material such as tissue paper or tissue paper which may contain polymeric fibers which provides strength to the tissue paper and which are moistened with a liquid cleaning agent. The cleaning agent may also contain a medicament, deodorant or the like. Since the tissue is moist, it must be stored in a container which seals the tissue from the atmosphere surrounding the dispenser in order to prevent liquid from evaporating from the tissue. In addition, the dispenser must permit ease of access to moist tissue for the user so that it can be easily dispensed in the desired amount by the user. The requirements for sealing and ease of access present conflicting criteria since the ease of access requirement also requires that at least a portion of the moist tissue be readily accessible to the user without opening the dispenser. Thus, the exposed tissue provides a means for allowing evaporation from the moist tissue stored in the dispenser which evaporation is to be minimized.

It is also desirable that the dispenser can be conveniently stored in the area of use, which is primarily the bathroom portion of a living area. In addition, it is desirable that the dispenser be reusable so that, after all of the moist tissue has been used, the dispenser can be opened to insert a new supply of moist tissue, thereby eliminating the need for purchasing a new dispenser with each new source of moist tissue. Thus, the dispenser must be capable of being resealed after a new supply of moist tissue has been added to the dispenser. Since the moist tissue normally is used in the bathroom, it would desirable to provide a means for storing the dispenser which cooperates with conventional bathroom fixtures such a spindle upon which a roller of dry toilet paper wound about a hollow core is stored. Such a storage means would provide the user with a convenient choice of dry or moist tissue.

U.S. Pat. No. 3,837,595 discloses a dispenser for a moist tissue roll in the form of a cylindrical housing. The cylindrical housing includes an open cylinder and one or more circular sealing rims which close and seal the openings in the cylinder. The cylinder contains a slot through which the moist tissue is dispensed. When it is desired to replace a roll of moist tissue, the sealing rim or rims are detached from the cylinder, a new roll of moist tissue is placed into the cylinder and the end of the roll is rethreaded through the slot in the cylinder. In addition, the sealing rims must be properly positioned to effect desired sealing to prevent moisture evaporation from the new roll. This dispenser is undesirable since it cannot be utilized with a conventional bathroom tissue support structure which includes a spindle.

U.S. Pat. No. 4,235,333 discloses a dispensing device for moist tissue which must be affixed to a bathroom wall. In addition, when the tissue is dispensed from the dispenser, a cover must be lifted to permit access to the moist tissue. While the cover is lifted, a liquid evaporates from the tissue so that it eventually becomes undesirably dry.

U.S. Pat. No. 3,310,353 discloses a dispenser for moist tissue. The dispenser has a cylindrical configuration formed from two sections which are hinged together. The interior of the dispenser is sealed from the surrounding atmosphere either with a spring loaded plate at the dispenser exit or with an auxiliary storing means for added liquid through which the moist tissue is passed. No means are provided for storing the dispenser on a conventional spindle for toilet paper.

U.S. Pat. No. 4,566,606 discloses a dispenser for moist tissue which is adapted to be positioned on a flat surface such as a floor or table. No means are provided for securing the dispenser to a conventional toilet tissue spindle.

Accordingly, it would be desirable to provide a dispenser for moist tissue which permits dispensing a desirable length of tissue while sealing the moist tissue from the atmosphere to prevent tissue drying. In addition, it would be desirable to provide such a dispenser which permits dispensing tissue without opening the dispenser. In addition, it would be desirable to provide such a dispenser which can be secured to existing conventional storing mean for dry toilet tissue. Furthermore, it would be desirable to provide such a dispenser which also can be positioned on or against a horizontal or vertical flat surface to provide convenience in dispensing moist tissue at a variety of locations.

SUMMARY OF THE INVENTION

This invention provides a dispenser for moist tissue formed with two housing sections joined together by a sealed hinged means and which are also capable of being secured together with two arms positioned at opposite ends of the dispenser. The arms are adapted to be secured to a fixed element so that the dispenser can be hung from the fixed element. The means for securing the arms to the housing sections effect a tight contact between the sections so that the interior of the dispenser is effectively sealed from the outside atmosphere. A leading edge of tissue housed within the dispenser is positioned within a slit defined by the juncture of the two housing sections. A flange can be provided on each housing section at the slit so that tissue being dispensed must be passed between the flanges prior to being detached from the tissue within the dispenser by the user. The flanges extend substantially along the length of the slit so that they provide a sealing means for the tissue positioned within the dispenser and thereby prevent excessive evaporation of liquid from the tissue. A flange positioned on a top surface of tissue being dispensed can also include a cover means which can be lifted by the user to expose tissue positioned between the flanges and so that the tissue can be pulled by the user from the dispenser for use. The arms utilized to hang the dispenser also can be provided with means for temporarily joining them in a compact position so that the entire dispenser, including the arms can be easily packaged during manufacture for shipment to a desired point of use. The dispenser also can be provided with means for supporting it on a relatively flat horizontal surface or a relatively flat vertical surface.

DESCRIPTION OF THE PREFERRED EMBODIMENT

The tissue dispenser of this invention is capable of being hung from a fixed support, positioned on a relatively flat horizontal surface or positioned on relatively flat vertical surface. The dispenser of this invention is also capable of housing moist tissue and maintaining it moist by preventing evaporation of liquid in the moist tissue during storage. In addition, the dispenser of this invention permits removal of desired lengths of tissue without opening the dispenser. The means provided for hanging the dispenser of this invention also effects sealing of the interior of the dispenser after a source of moist tissue has been positioned within the dispenser.

Figure 1:
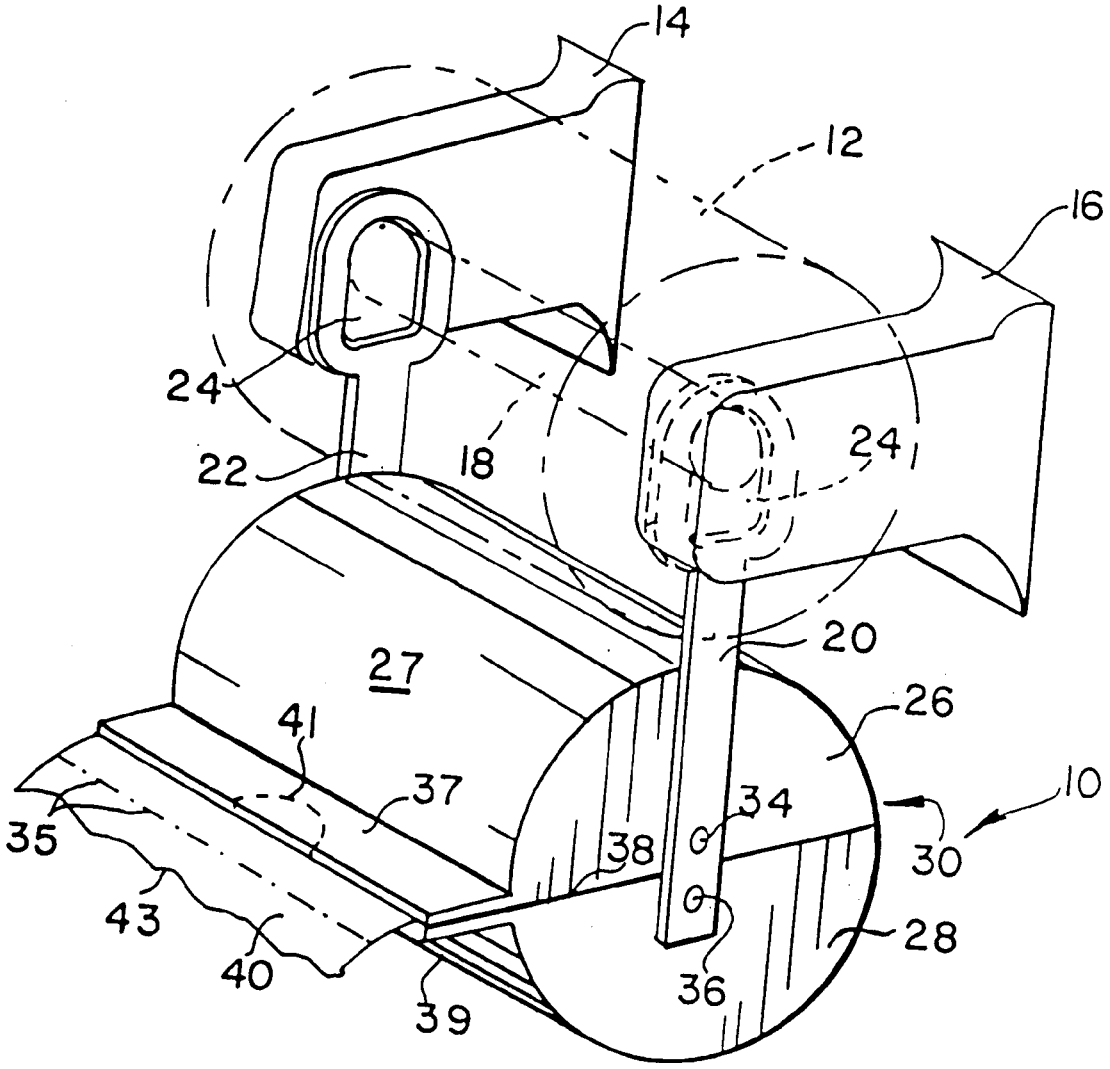
FIG. 1 is an isometric view of an embodiment of the dispenser of this invention in position for use.

Referring to FIG. 1, a dispenser of this invention 10 is hung from a conventional bathroom fixture for housing dry tissue 12. The bathroom fixture includes two prongs 14 and 16, each having recesses to accommodate and end of a spring-loaded spindle 18. A roll of toilet tissue 12 has a centrally located hole through which spindle 18 extends. The spindle 18 can be removed from the prongs 14 and 16 by compressing a spring (not shown) therein so that the roll of tissue 12 can be replaced by a new roll of tissue.

The dispenser 10 of this invention includes two arms 20 and 22. Each of the arms 20 and 22 includes an opening 24 to accommodate spindle 18. Alternatively, a hook means or the like can be utilized rather than an opening to hang the dispenser. The arms 20 and 22 are positioned between the tissue roll 12 and one of the prongs 14 and 16. A housing 27 formed of housing sections 26 and 28 are joined together by a rearwood hinge 30 which seals the interior of the housing formed from housing sections 26 and 28 from the surrounding atmosphere 32. The interior of the housing 27 also is sealed from the outside atmosphere 32 by connections 34 and 36 which connect the arms 20 and 22 to housing sections 26 and 28. The connections 34 and 36 are spaced apart a distance so that a seal is effected along joining line 38 of housing sections 26 and 28 between the atmosphere 32 and the interior of dispenser 27. A flange 37 on housing 26 is retained sufficiently close to the flange 39 on housing section 28 so that, together with the moist tissue 40 positioned between the two flanges 37 and 39, an effective seal is formed between the atmosphere 32 and the interior of housing 27. Thus, the interior of housing 27 is sealed from the atmosphere by means of a rearwood hinge 30, the connections 34 and 36 which form a seal at line 38 which extends along both side surfaces of the housing and the seal is formed by the flanges 37 and 39 and the moist tissue 40. These seals are maintained tight by controlling the distance between connections 34 and 36 which provide the means for attaching the arms 20 and 22 to housing sections 26 and 28. A slot 41 optionally can be formed in flange 37. The slot 41 is useful for the user since it exposes a portion of the tissue 40 so that the user can use a finger and/or thumb to pull the leading edge 43 of the tissue 40 away from the interior of housing 27. The tissue 40 optionally can be segmented by partial slits 35 extending across the width of the tissue 40.

Figure 1A:
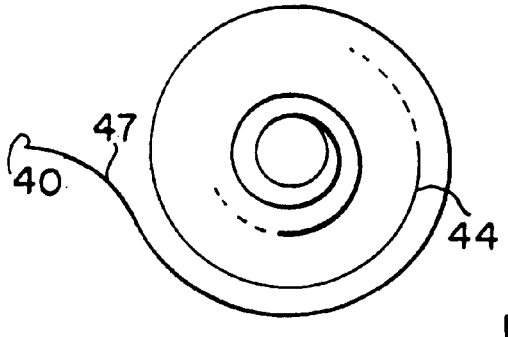
FIG. 1A is a side view of one configuration of rolled moist tissue to be housed within the dispenser of FIG. 1.
Figure 1B:
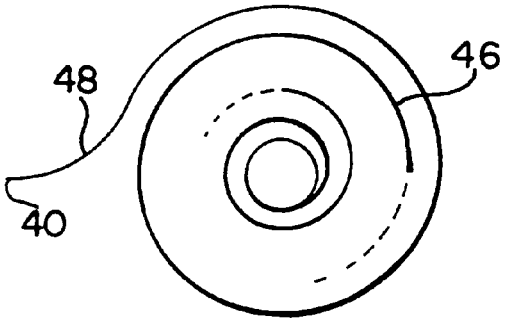
FIG. 1B is a side view of a second configuration of moist tissue to be housed within the dispenser of FIG. 1.
Figure 1C:
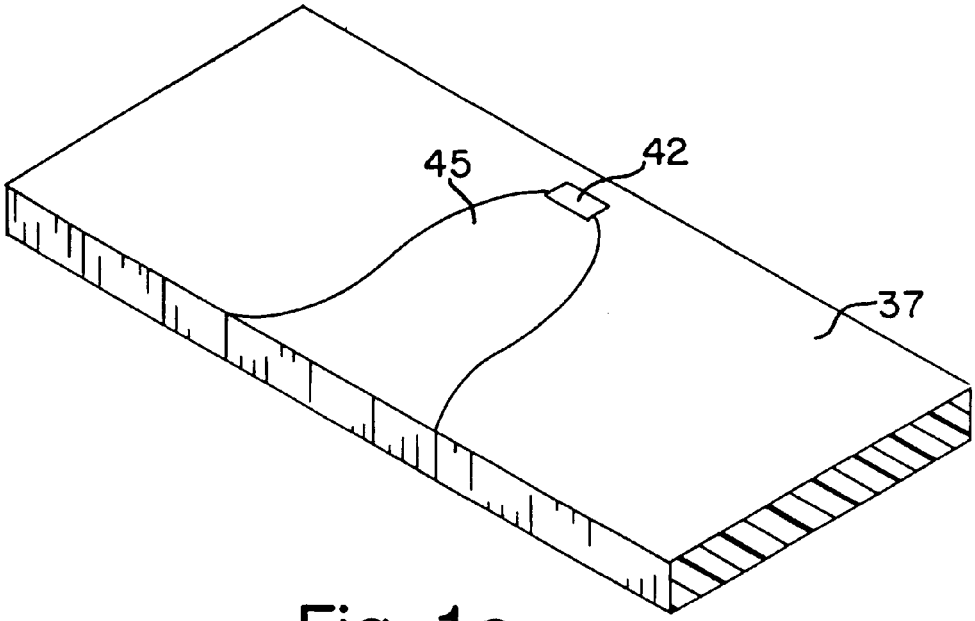
FIG. 1C is a partial isometric view of an alternative means to permit dispensing of tissue from the dispenser of FIG. 1.
Figure 4:
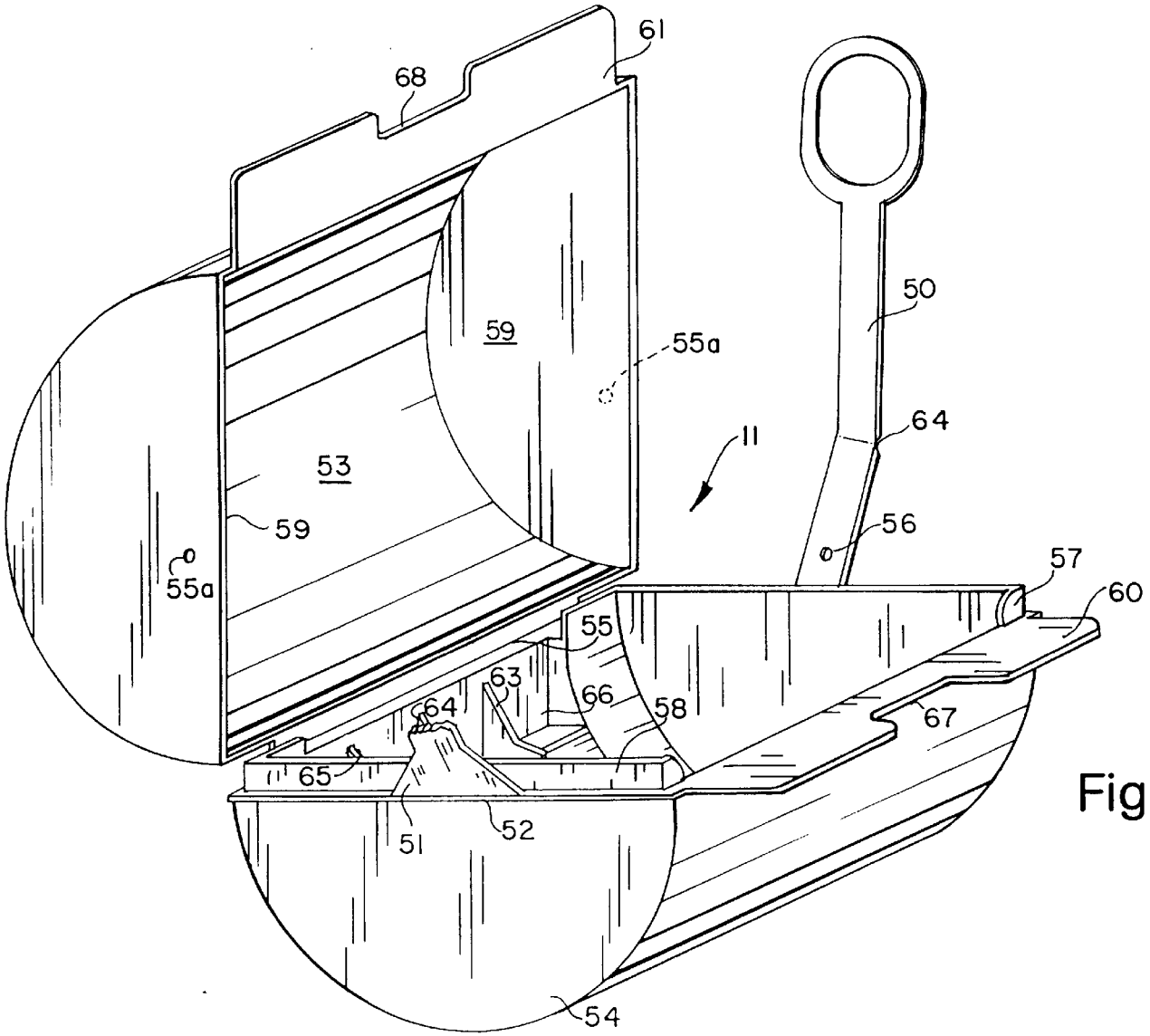
FIG. 4 is a isometric view of the dispenser of FIG. 3 showing an interior of a dispenser of this invention.

An alternative embodiment shown in FIG. 1C wherein the flange 37 is provided with a cover 45 which is secured to the flange 37 by means of hinge 42 so that the cover 45 can be lifted away from flange 37 by means of the hinge 42 to expose a portion of the moist tissue and thereby permit pulling of the tissue by means of a thumb and/or finger of the user. The cover 45 provides advantages in that it minimizes evaporation of moisture from the tissue as compared to a tissue which would be otherwise exposed. The cover 45 may also be secured to the flange 61, as shown in FIG. 4, by means of the hinge 42. The housing sections 26 and 28, the flanges 37 and 39, the cover 45 and the hinge 42 may be formed as a single molded piece.

Alternative roll configurations for the moisten tissue within the housing 27 shown in FIGS. 1A and 1B. The roll configuration of FIGS. 1A and 1B can be continuous or partially cut along their width to promote ease of tearing the tissue along the partial cut. It is preferred to utilize the configuration in FIG. 1A since, during use, the roll 44 which is pulled toward the flanges 37 and 39 when dispensing tissue will roll away from the outside layer 47 without pulling the leading edge 40 into the housing 27. In contrast, the configuration 46 in FIG. 1B will tend to pull the outer layer 48 back into the housing 27 and may lead to difficulty in subsequent use since the leading edge 40 of the tissue may not be exposed to the user. In this embodiment, the slot 41 is made larger to assure exposure of the leading edge 40.

Figure 2:
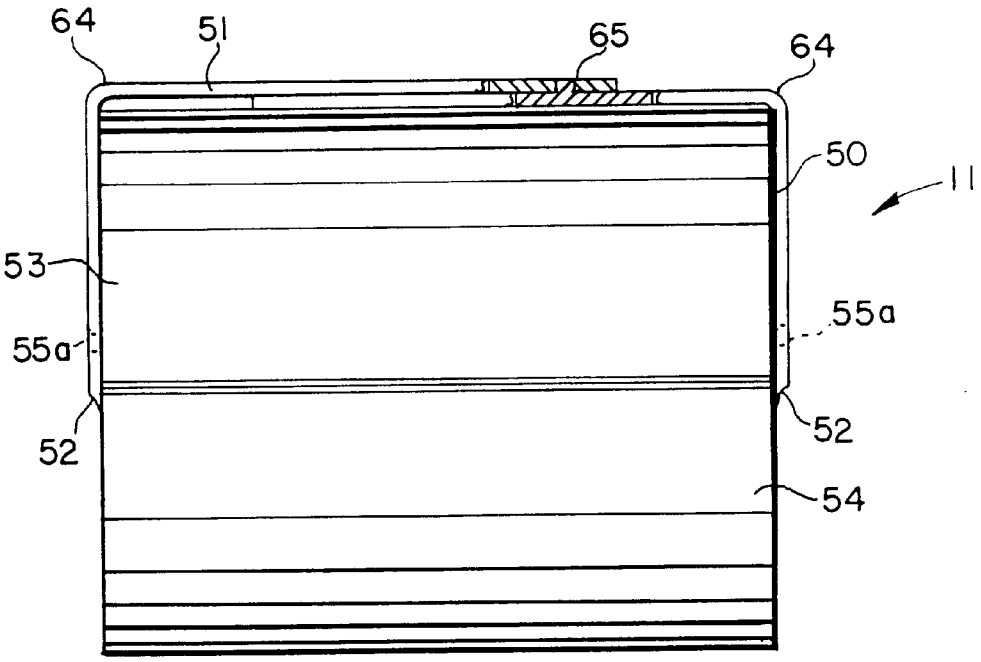
FIG. 2 is front view, in partial cross-section, illustrating a means for storing support arms of the dispenser of this invention.
Figure 2A:
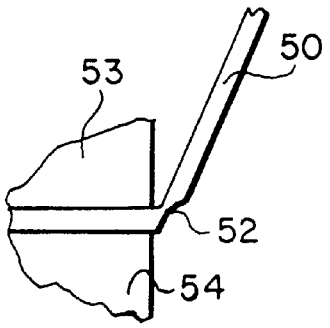
FIG. 2A illustrates one means for attaching arms to the dispenser of this invention.

An alternative preferred embodiment of the arm structure utilized on the dispenser of this invention is shown in FIGS. 2 and 2A. The arms 50 and 51 are shown in a folded position suitable for packaging the dispenser 11. Each arm 50 and 51 is molded integrally with section 54 of the dispenser which is integrally molded with section 53 to form a single molded piece. As shown with particularly in FIG. 2A, a hinge is formed by molding a thinner portion 52 of the arm 50 which functions as a hinge, known in the art as a living hinge, about which the arm 50 is pivotable. The arm 51 is molded in the same manner as the arm 50 to include a living hinge. The dispenser 11 is formed from two semicylindrical sections 53 and 54 which are also joined together by a living hinge 55 which extend along the length of the sections 53 and 54 so that the living hinge 55 functions as a seal between the sections 53 and 54 when the dispenser 11 is closed. The arms 50 and 51 are joined to the section 53 by posts 55*a* which are molded integrally with section 53 and which effect a snap fit when positioned within mating holes 56 within arm 50 and 51. Thus, the arms 50 and 51 each have a living hinge 64 and are attached to the section 54 by means of the living hinge 52 and to the section 53 by the snap fit formed posts 55*a*. The distance between the living hinges 52 on the arms 50 and 51 and the posts 55*a* is regulated so that the sections 53 and 54 are tightly positioned against each other to form a seal about the periphery of the sections 53 and 54.

Also, as shown in FIGS. 2 and 4, the arms 50 and 51 can be provided with a second living hinge 64 so that the arms 50 and 51 can be more easily folded into a compact position and joined together by means of a snap fit which include a post 65 formed integrally with one of the arms 50 or 51 which mates with a hole in the other of the arms 50 and 51. When the dispenser is in the configuration shown in FIG. 2, it can be more easily package with a conventional packaging material such as a thin polymeric sheet which can be sealed to itself about the entire dispenser 11 such as a shrink wrap. The second living hinge 64, post 65, and hole can also be used with the embodiment shown in FIG. 1 to more easily package the dispenser.

Figure 3:
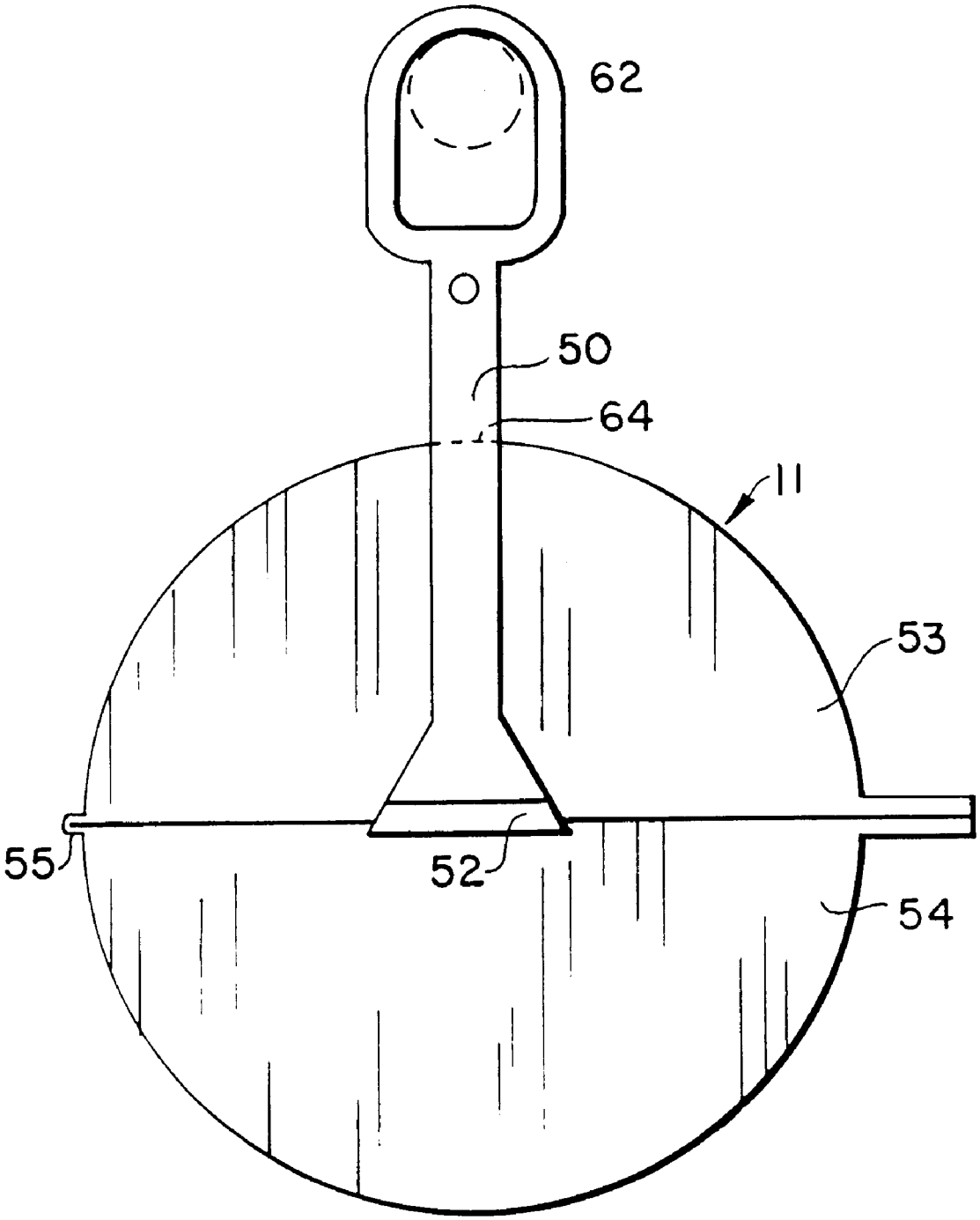
FIG. 3 is side view of an alternative embodiment of this invention utilizing the means for attaching arms shown in FIG. 2A.

As shown in FIG. 4, walls 57 and 58 can be molded integrally with the bottom section 54 so that they contact the interior side surfaces 59 of section 53 to provide additional sealing of the interior volume of dispenser 11 from the surrounding atmosphere. If desired, the walls 57 and 58 can be joined along the rearwood portion of the dispenser 11 to form a single continuous wall which also provides additional sealing adjacent living hinge 55. Sealing of the front portion of the dispenser 11 from which the moist tissue is dispensed is effected by means of extensions 60 and 61 which, together with the moist tissue therebetween being dispensed forms a tight seal between the interior of the dispenser 11 and the surrounding atmosphere. Thus, the arms 50 and 51 function as both the means for hanging the dispenser 11 from a spindle 62 (FIG. 3) and as a means for effecting sealing of the interior of the dispenser 11 from the surrounding atmosphere so that the moist tissue housed therein remains moist.

As shown in FIG. 4, the interior surface of the dispenser 11 can be modified to reduce the frictional force exerted by the interior surface of the dispenser when a roll of moist tissue housed therein is unrolled during dispensing. Raised flanges 63, 64 and 65 which extend about substantially the entire periphery of the interior surface 66 of section 54 raise the roll of moist tissue away from interior surface 66 so that the moist tissue contacts only the area presented by flanges 63, 64 and 65 rather than entire area 66 of the interior surface of section 54. The effect of the flanges 63, 64 and 65 is to reduce the frictional forces on the tissue being dispensed. The flanges 60 and 61 are provided with slots 67 and 68 so that at least portion of the tissue positioned between flanges 60 and 61 are visible to the user and can be grasped by the user with one hand.

Figure 5:
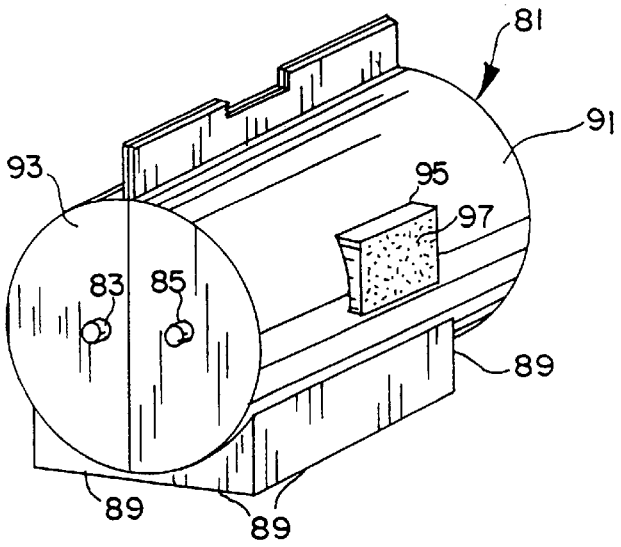
FIG. 5 illustrates an alternative embodiment of the dispenser of this invention.

Referring to FIG. 5, an embodiment of this invention is shown which is capable of being hung and which is also capable of being positioned on a horizontal substantially flat surface or a vertical substantially flat surface. The dispenser 81 includes posts 83 and 85 which are used in conjunction with arms as set forth above to effect hanging of the dispenser 81. The dispenser 81 also is provided with a support 87 which includes a relatively flat bottom surface 89 on each section 91 and 93 which effectively form a geometrical shape which permits positioning the dispenser 81 on a horizontal surface when desired. A detailed example of the surface 89 is shown is FIG. 8 and is described below. The dispenser 81 is also provided with a vertical extension 95 having 1 relatively flat surface 97 which comprises prong like extension that can be contacted with a patch having fibers on a vertical surface such as a wall. The prongs 97 and the fibers of the patch function together to secure the dispenser 81 to the vertical wall surface. Conventional prong and fiber are arrangements are available under the trademark, VELCRO® fasteners.

Figure 6:
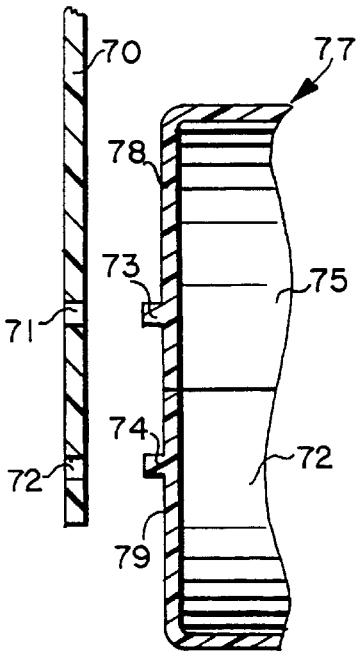
FIG. 6 is partial cross-sectional view illustrating one means for attaching the arms to the dispenser of this invention.

An alternative arm construction is shown in FIG. 6. The arm 70 includes two holes 71 and 72 which mate respectively with posts 73 and 74. The posts 73 and 74 are spaced apart a distance such that when the arm 70 is positioned over the posts 73 and 74, the sections 75 and 76 of the dispenser 77 are tightly contacted with each other to form an effective seal between the interior of the dispenser 77 and the surrounding atmosphere. The arm 70 is also provided with a hook or a ring or the like which permits hanging the dispenser 77 from the conventional spindle such as is described above with reference to other embodiments of this invention. Similarly, the dispenser 77 can be provided with sealing means and friction reduction means as is described above in reference to other embodiments of this invention. Also, joining of the arm 70 to the sections 75 and 76 can be effected by posts rather than holes positioned on arm 70 which mate with holes rather than posts 73 and 74 in sections 75 and 76. However, when such holes are used in the section 75 and 76 they do not extend through the entire thickness of the walls 78 and 79 so that sealing of the interior of the dispenser 77 can be maintained.

Figure 7:
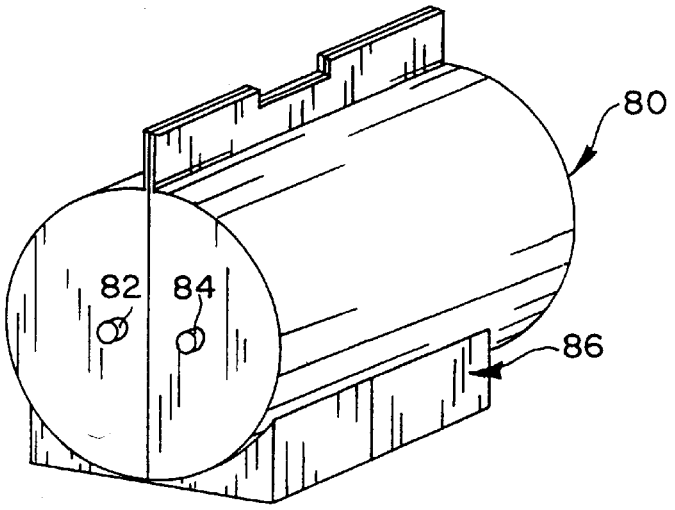
FIG. 7 is an isometric view of a dispenser of this invention including means for positioning the dispenser of this invention on a horizontal relatively flat surface.
Figure 8:
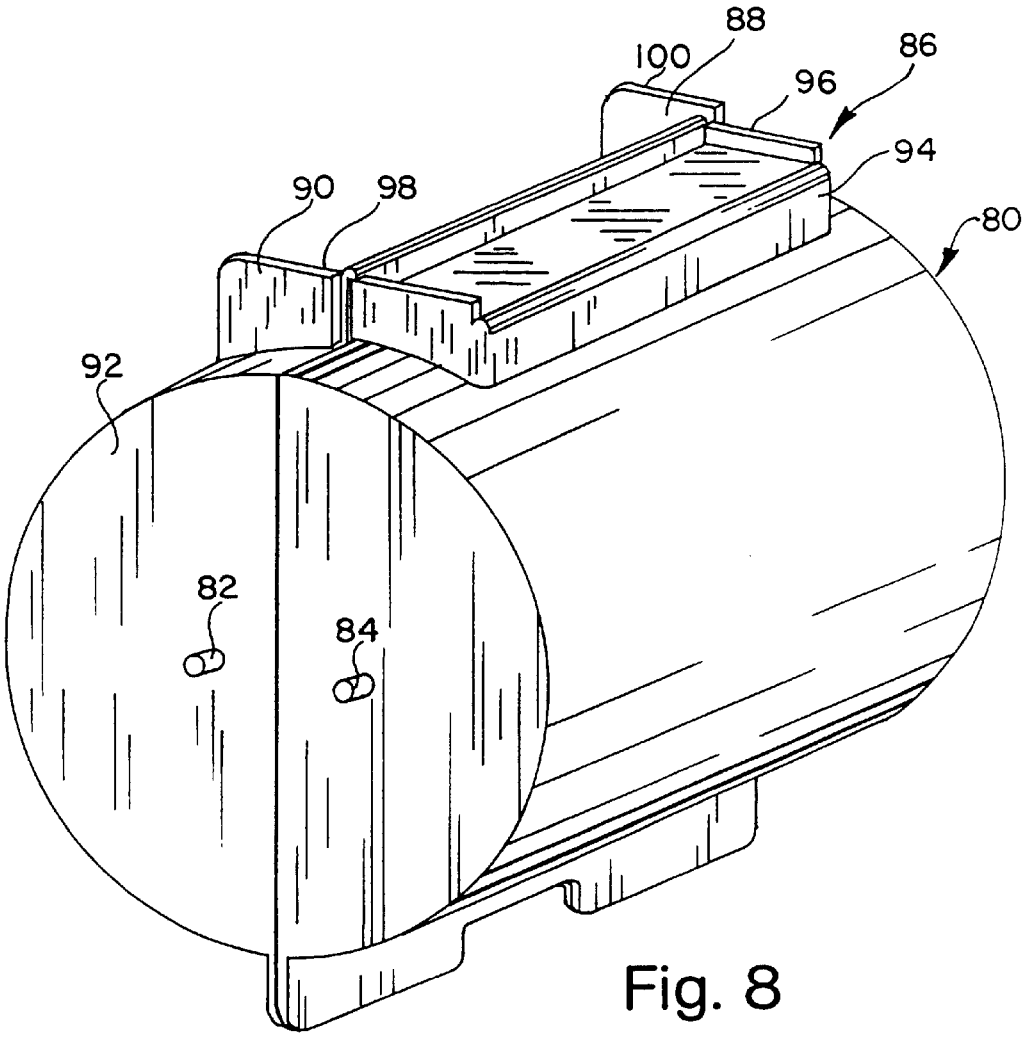
FIG. 8 is isometric view of the dispenser of FIG. 7 is positioned 180° from the position shown in FIG. 7.

Referring to FIGS. 7 and 8, an alternative embodiment of this invention is shown which can be positioned by being hung or by being placed on a horizontal surface. The dispenser 80 includes posts 82 and 84 which are used inconjunction with arms as described above. The dispenser 80 also includes a three sided support means 86 which permits the dispenser to be positioned on a relatively flat horizontal surface. The support means 86 includes two flanges 88 and 90 on section 92 and a three sided section 94 having a surface 96 which can be position on a relatively flat horizontal surface. In addition, the relatively flat surfaces 98 and 100 on flanges 88 and 90 also assist in positioning the dispenser on a relatively flat horizontal surface. When the dispenser 80 is opened, supports section 94, which has a width shorter than the distance between the arms 88 and 89, can move into position between the arms 88 and 90 thereby permitting the dispenser 88 to be opened.

Figure 9:
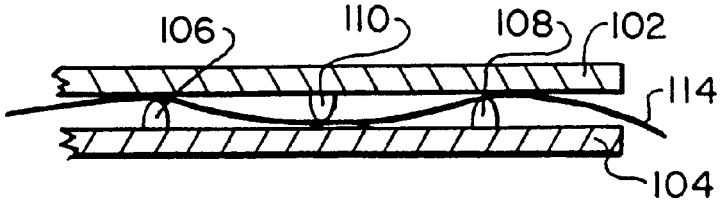
FIG. 9 is a partial cross-sectional view of the slit opening of the dispenser of FIG. 10 taking along line 9-line.
Figure 10:
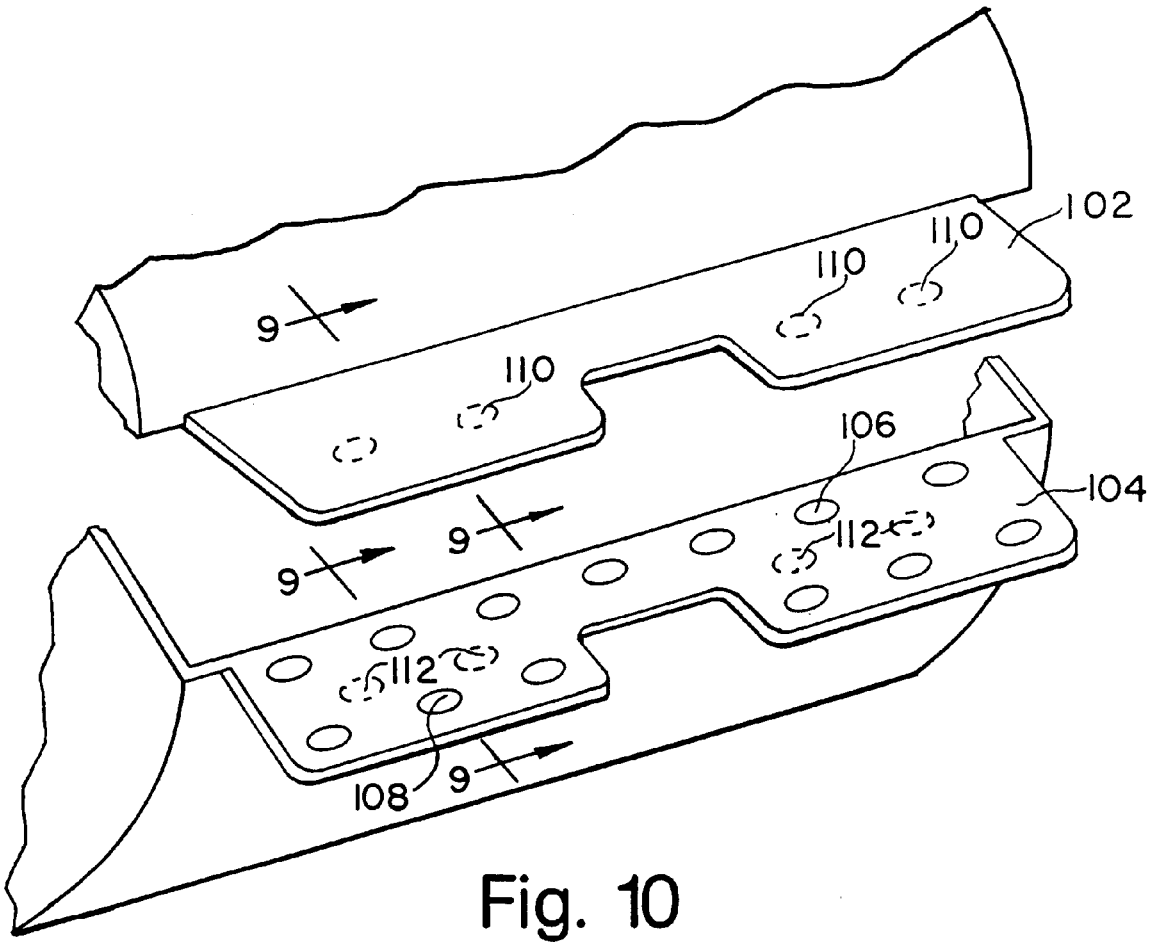
FIG. 10 is partial isometric view of the slit opening of a dispenser of this invention.

FIGS. 9 and 10 illustrate alternative means for increasing sealing in the volume positioned between flanges 102 and 104. As shown in FIG. 10, the flange 104 includes two rows of prongs 106 and 108 having blunted end surfaces so that they do not rip the tissue positioned between the flanges 102 and 104. The top lip 102 includes one row of prongs 110 which, when the lips 102 and 104 are positioned adjacent each other, are in the position shown as row 112. The prongs 108, 110 and 106 present a tortuous path for any vapor within the dispenser and together with the moist tissue 114 provide adequate seal to prevent substantial evaporation of vapor from a dispenser.

Figure 11:
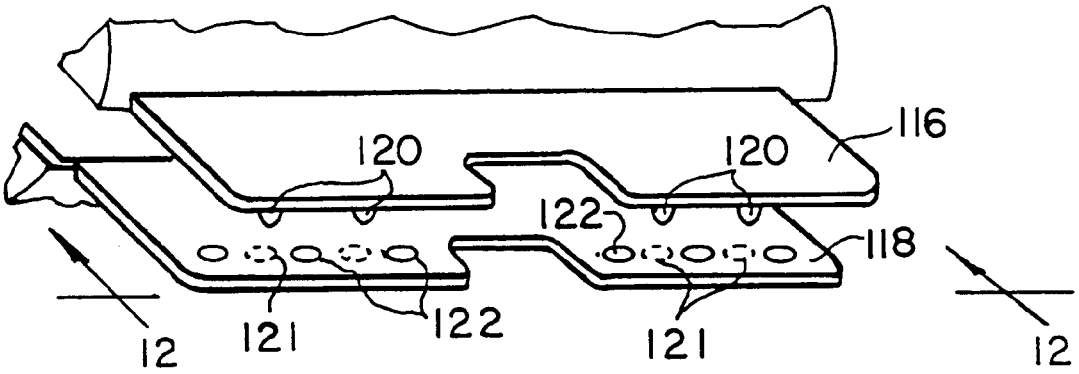
FIG. 11 is a partial isometric view of an alternative slit configuration of the dispenser of this invention.
Figure 12:
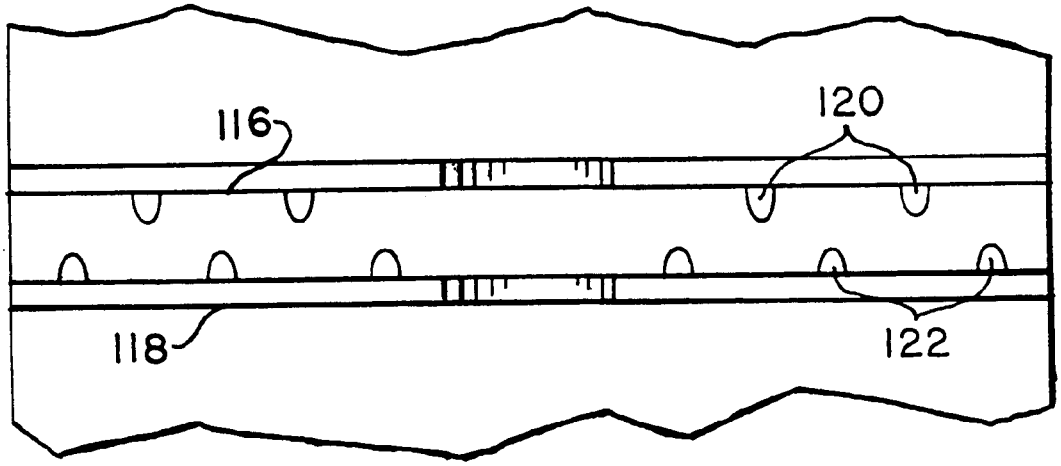
FIG. 12 is front view taking along line 12—12 of the dispenser of FIG. 11.

Referring to FIGS. 11 and 12, an alternative arrangement of prongs position on flanges 116 and 118 is shown. The prongs 120 are positioned at the positions 121 when the flanges 116 and 118 are closed so that they and adjacent prongs 122 form a new row of prongs rather than having the prongs off set in the manner shown in FIG. 10.

This invention has been described specifically with reference to a dispenser formed of one piece. However, it is to be understood the body of the dispenser also can formed from two sections such as two substantially semicylindrical subsections so long as the sections can be sealing joined by means of the arms utilized to hang the dispenser.

Figure 13:
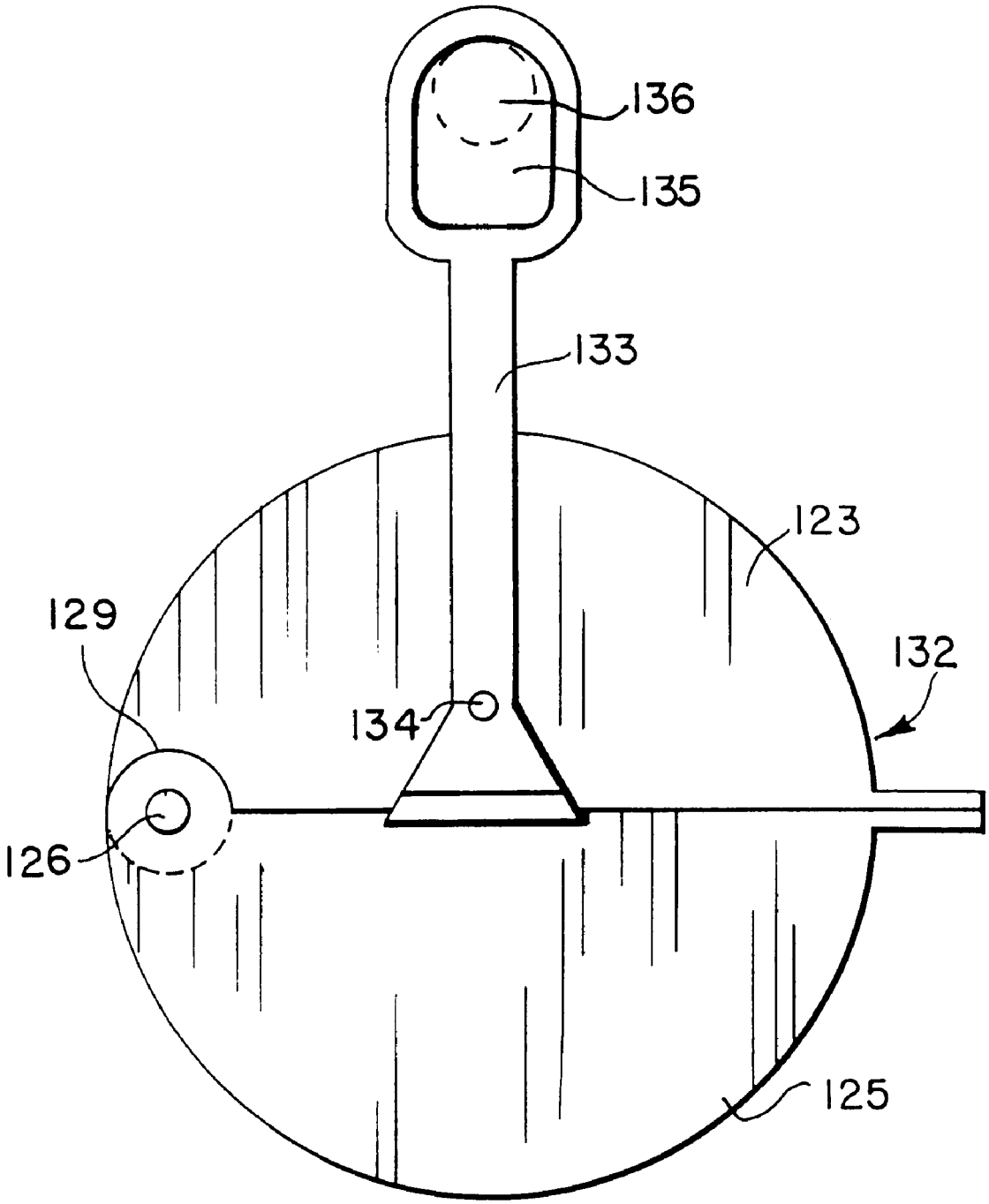
FIG. 13 is a side view of an alternative dispenser of this invention formed from two housing sections.
Figure 14:
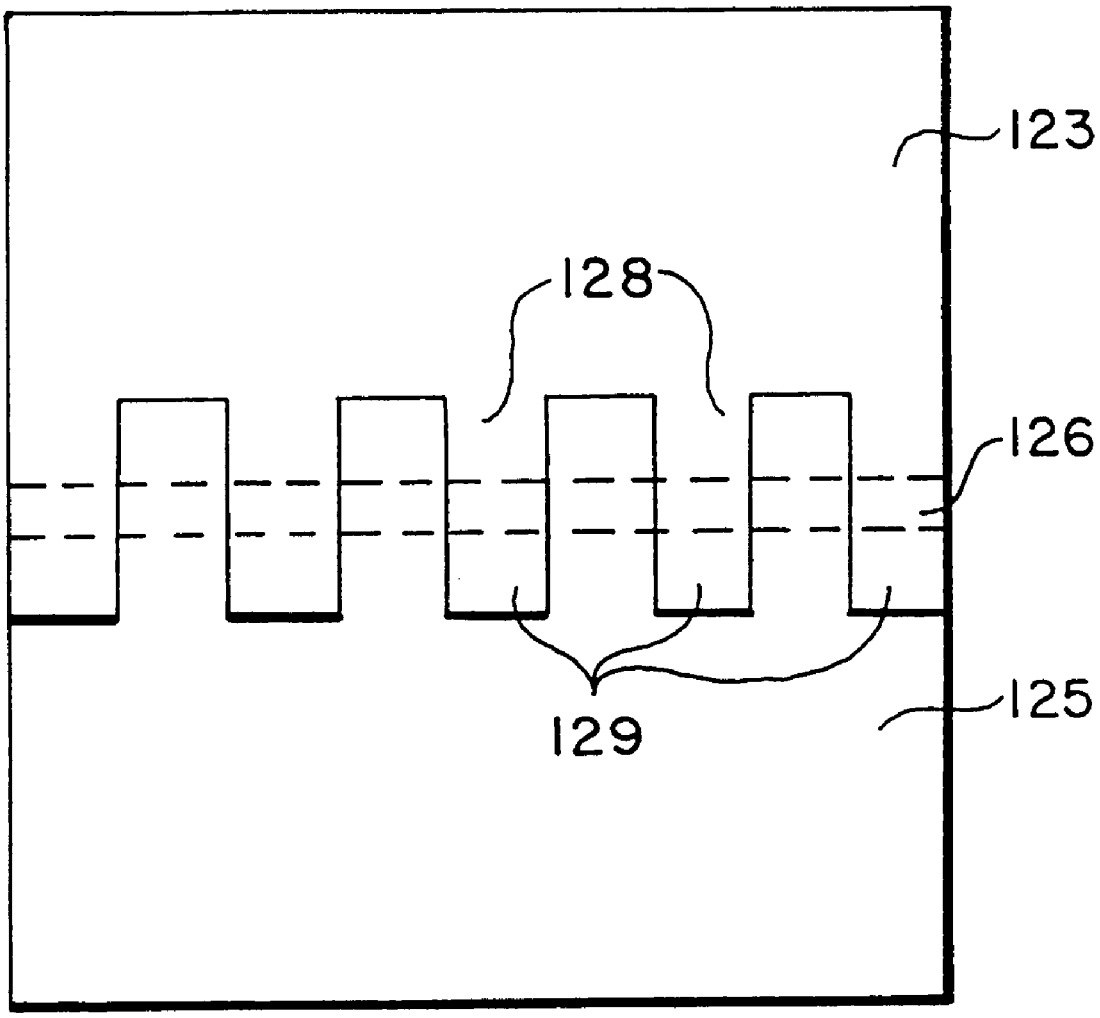
FIG. 14 is a back view of the dispenser of FIG. 13.
Figure 15:
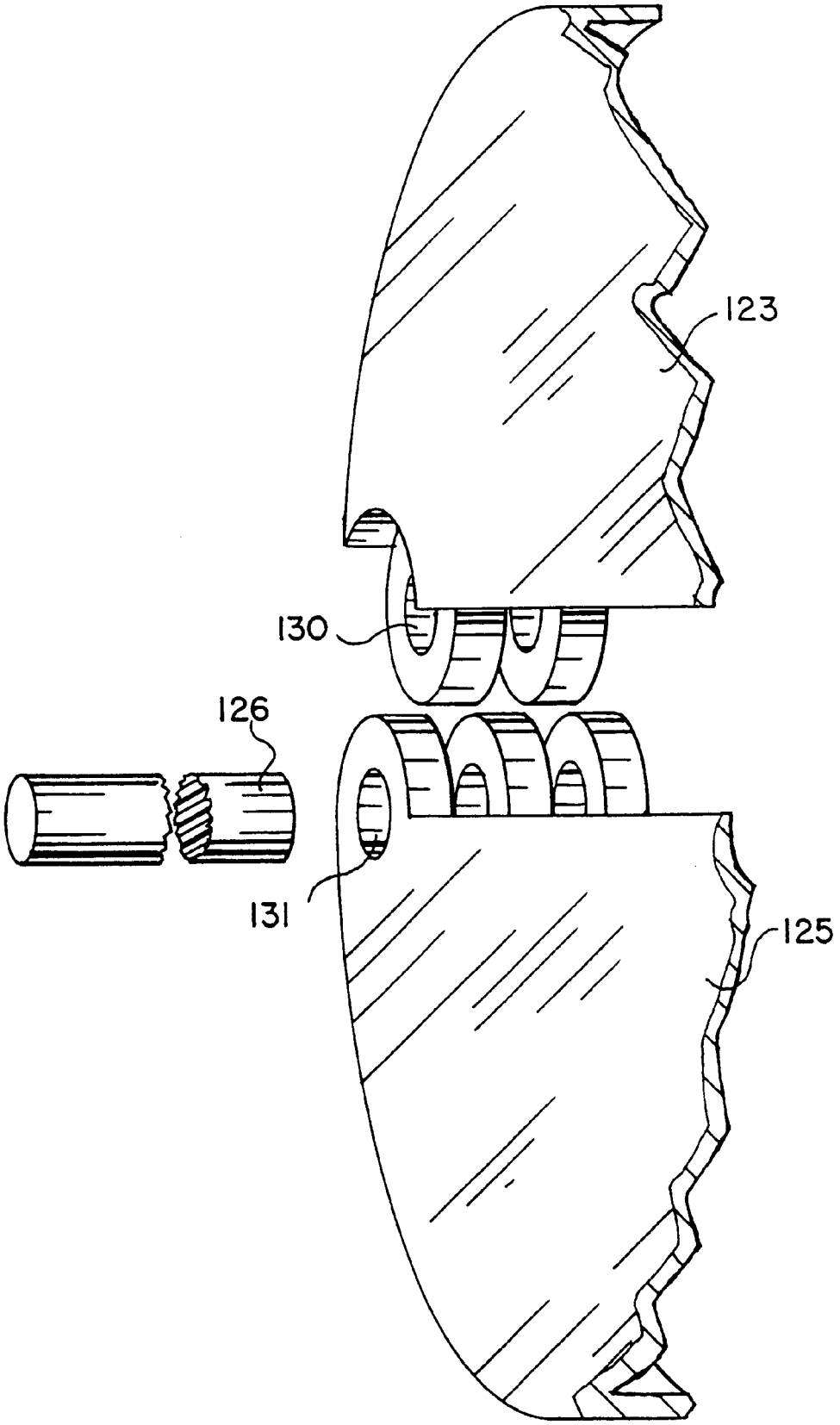
FIG. 15 is an exploded partial view of a rearward portion of the dispenser of FIGS. 13 and 14.

A dispenser having a housing 132 formed from two section 123 and 125 is shown in FIGS. 13, 14 and 15. Rod 126 extends through holes 130 in fingers 128 of section 123 and through holes 131 in fingers 129 of section 125. Two arms 133 are secured to section 125 such as by a living hinge described above. The arms 133 are secured to section 123 by being snap fit on posts 134 as described above. At least one of the sections 124 or 125 is free to rotate about rod 126 to permit opening the housing 132 to replenish the moist tissue supply. The arms 133 include openings 135 to permit hanging the housing 132 on spindle 136.

Figure 16:
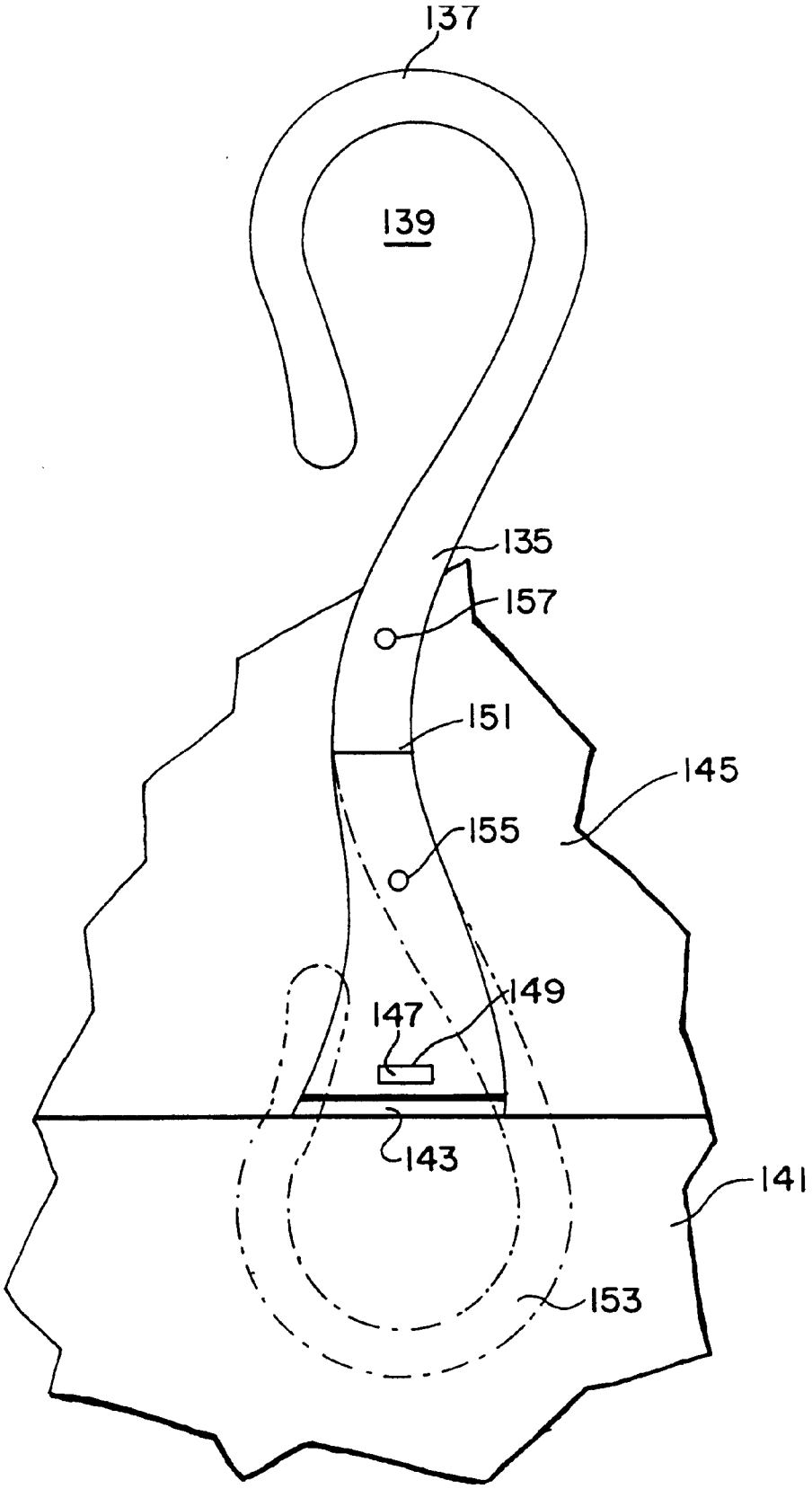
FIG. 16 illustrates an alternative arm structure for the dispenser of this invention.

Referring to FIG. 16, the arm 135 includes a hook 137 at one end thereof. The arm 135 and hook 137 are sufficiently flexible so that they can be bent to permit a spindle positioned as part of a conventional toilet tissue holder to be inserted into the opening 139 defined by the hook 137 without removing the spindle from the holder. The arm 135 is attached to housing section 141 by a living hinge 143 as described above with reference to FIG. 2A. The arm 135 also is attached to housing section 145 by a post 147 which extends through opening 149 in arm 135. Post 147 is formed integrally with housing section 145. The arm 135 also includes a second living hinge 151 which permits arm 135 to be folded in the position illustrated by dotted lines 153. The arm 135 optionally can include a post 155 which fits in opening 157 to secure the folded arm in place. Alternatively, the post 155 and opening 157 can be reversed.

What is claimed is:

1. A dispenser for housing a roll of moist tissue which comprises:

a hollow housing shaped to store said roll of moist tissue, said hollow housing consisting of a first and second housing section joined together, each of said housing sections having a flange, said flanges being positioned adjacent each other to form a slit on a periphery of said housing when said housing sections are in a closed position, each of said housing sections having opposing end surfaces, two arms, wherein each of said arms is attached at one end thereof to a respective one of said opposing end surfaces of said first housing section, means for releasably securing each of said arms to a respective one of said opposing end surfaces of said second housing section to hold said housing sections in a sealing relationship with respect to each other when said housing sections are in said closed position, and each of said arms being shaped at an end opposite to said end of said arm attached to said first housing section for hanging said dispenser from a fixed substrate.

2. The dispenser of claim 1 comprising a single molded piece.

3. The dispenser of claim 1 wherein at least one of said flanges includes a slot.

4. The dispenser of claim 3 which includes a cover for said slot, said cover being connected to said at least one of said flanges by a hinge.

5. The dispenser of claim 4 wherein each of said arms is attached to said first housing section by a hinge.

6. The dispenser of any one of claims 1, 2, 3, or 5 including means for folding said arms.

7. The dispenser of any one of claims 1–3 wherein each of said arms is attached to said first housing section by a hinge.

8. The dispenser of any one of claims 1–3 including means for attaching said arms together.

9. A dispenser for housing a roll of moist tissue which comprises:

a hollow housing shaped to store said roll of moist tissue, said hollow housing consisting of a first and second housing section joined together, each of said housing sections having a flange, said flanges being positioned adjacent each other to form a slit on a periphery of said housing when said housing sections are in a closed position, each of said housing sections having two opposing end surfaces, two arms, wherein each of said arms is attached at one end thereof to a respective one of said opposing end surfaces of said first housing section, means for releasably securing each of said arms to a respective one of said opposing end surfaces of said second housing section to hold said housing sections in a sealing relationship with respect to each other when said housing sections are in said closed position, and each of said arms being shaped at an end opposite to said end attached to said first housing section for hanging said housing from a spindle secured to a fixed substrate.

10. The dispenser of claim 9 comprising a single molded piece.

11. The dispenser of claim 9 wherein at least one of said flanges includes a slot.

12. The dispenser of claim 11 which includes a cover for said slot, said cover being connected to said at least one of said flanges by a hinge.

13. The dispenser of any one of claims 9–11 wherein each of said arms is attached to said first housing section by a hinge.

14. The dispenser of any one of claims 9–11 including means for attaching said arms together.

15. The dispenser of any one of claims 9–11 including means for folding said arms.

16. A dispenser for housing a roll of moist tissue which comprises:

a hollow housing shaped to store said roll of moist tissue, said hollow housing consisting of a first and second housing section joined together, each of said housing sections having a flange, said flanges being positioned adjacent each other to form a slit through a periphery of said housing when said housing sections are in a closed position, said slit being sized to permit moist tissue from said roll of moist tissue to pass therethrough, each of said housing sections having two opposing end surfaces, said housing having two opposing sides, each said side consisting of one of said opposing end surfaces of said first housing section and one of said opposing end surfaces of said second housing section, two arms, wherein each of said arms is releasably secured at one end thereof to said opposing end surfaces of a respective one of said sides of said housing to hold said housing sections in sealing relationship with respect to each other and each of said arms being shaped at an end opposite to said end of said arm secured to said housing for hanging said housing from a fixed substrate.

17. The dispenser of claim 16 wherein at least one of said flanges includes a slot.

18. The dispenser of claim 17 which includes a cover for said slot, said cover being connected to said at least one of said flanges by a hinge.

19. The dispenser of claim 18 wherein said housing sections, said flanges and said cover are formed as a single piece.

20. The dispenser of any one of claims 16–19 including means for attaching said arms together.

21. The dispenser of any one of claims 16–19 including means for folding said arms.

22. A dispenser for housing a roll of moist tissue which comprises:

a hollow housing shaped to store said roll of moist tissue, said housing consisting of a first and second housing section joined together, each of said housing sections having a flange, said flanges being positioned adjacent each other to form a slit through a periphery of said housing when said housing sections are in a closed position, said slit being sized to permit moist tissue from said roll of moist tissue to pass therethrough, each of said housing sections having two opposing end surfaces, said housing having two opposing sides, each said side consisting of one of said opposing end surfaces of said first housing section and one of said opposing end surfaces of said second housing section two arms, wherein each of said arms is releasably secured at one end thereof to said opposing end surfaces of a respective one of said sides of said housing to hold said housing sections in sealing relationship with respect to each other, and each of said arms being shaped at an end opposite to said end of said arm secured to said housing for hanging said housing from a spindle secured to a fixed substrate.

23. The dispenser of claim 22 wherein at least one of said flanges includes a slot.

24. The dispenser of claim 23 which includes a cover for said slot, said cover being connected to said at least one of said flanges by a hinge.

25. The dispenser of claim 24 wherein said housing sections, said flanges and said cover are formed as a single piece.

26. The dispenser of any one of claims 22–25 including means for attaching said arms together.

27. The dispenser of any one of claims 22–25 including means for folding said arms.

28. A dispenser for housing a roll of moist tissue, the dispenser comprising:

a hollow housing including a first housing section and a second housing section, each of said housing sections having a first and second opposite end surface and a flange, the flanges of the first and second housing sections being capable of forming a slit when said housing sections are in a closed position, a first arm having a first end fixedly attached to said first opposite end surface of the first housing section and a second end having a first attachment member for hanging the housing from a fixture, the first end of the first arm including a first fastener releasably secured to said first opposite end surface of said second housing section for detachably securing said first opposite end surface of the first housing section to said second opposite end surface of the second housing section to seal an interior of the hollow housing; and a second arm having a first end fixedly attached to said second opposite end surface of the first housing section and a second end having a second attachment member for hanging the housing from the fixture, the first end of the second arm including a second fastener releasably secured to said second opposite end surface of said second housing section for detachably securing the second opposite end surface of the first housing section to said second opposite end surface of the second housing section to seal the interior of the hollow housing.

29. A dispenser for housing a roll of moist tissue, the dispenser comprising:

a hollow housing including a first housing section and a second housing section, each of said housing sections having a first and second opposite end surface and a flange, the flanges of the first and second housing sections being capable of forming a slit when said housing sections are in a closed position, a first sealing arm securing the first and second housing sections in a sealing relationship, a first end of the first sealing arm having a first attachment member detachably fastened to said first opposite end surface of the first housing section and a second attachment member detachably fastened to said first opposite end surface of the second housing section, a second end of the first sealing arm having a third attachment member for hanging the housing from a fixture; and a second sealing arm securing the first and second housing sections in said sealing relationship, a first end of the second sealing arm having a fourth attachment member detachably fastened to said second opposite end surface of the first housing section and a fifth attachment member detachably fastened to said second opposite end surface of the second housing section, a second end of the second sealing arm having a sixth attachment member for hanging the housing from the fixture.

30. The dispenser of claim 29, wherein the third and sixth attachment members are openings.

* * * * *